United States Patent [19]

Everett et al.

[11] Patent Number: 4,960,530

[45] Date of Patent: Oct. 2, 1990

[54] LUBRICATING OIL COMPOSITION

[75] Inventors: Armgard K. Everett, Warson Woods; Edmund F. Perozzi, Crestwood, both of Mo.

[73] Assignee: Ethyl Petroleum Additives, Inc., St. Louis, Mo.

[21] Appl. No.: 281,262

[22] Filed: Dec. 7, 1988

Related U.S. Application Data

[63] Continuation-in-part of Ser. No. 175,761, Mar. 31, 1988, abandoned.

[51] Int. Cl.[5] ..... C10M 135/04

[52] U.S. Cl. ..... 252/32.7 R; 252/48.6

[58] Field of Search ..... 252/45, 47, 47.5, 48.2, 252/48.6, 32.7 R

[56] References Cited

U.S. PATENT DOCUMENTS

| | | | |
|---|---|---|---|
| 3,933,659 | 1/1976 | Lyle et al. | 252/32.7 |
| 4,163,729 | 8/1979 | Adams | 252/18 |
| 4,201,684 | 5/1980 | Malec | 252/47.5 |
| 4,208,293 | 6/1980 | Zaweski | 252/51.5 |
| 4,236,898 | 12/1980 | Davis | 44/66 |
| 4,380,498 | 4/1983 | Kammann et al. | 252/48.6 |
| 4,380,499 | 4/1983 | Kammann, Jr. | 252/48.6 |
| 4,400,284 | 8/1983 | Jessup et al. | 252/49.6 |
| 4,406,802 | 9/1983 | Horodysky et al. | 252/49.6 |
| 4,439,336 | 3/1984 | Zaweski | 252/32.7 |
| 4,485,044 | 11/1984 | Kammann, Jr. et al. | 260/399 |
| 4,536,308 | 8/1985 | Pehler et al. | 252/32.7 |

*Primary Examiner*—Olik Chaudhuri
*Assistant Examiner*—James M. Hunter, Jr.
*Attorney, Agent, or Firm*—David M. Bunnell

[57] ABSTRACT

Engine wear and sludge are reduced by using in the engine crankcase a fomulated motor oil containing a small amount of a cosulfurized blend of a carboxylic acid ester material and a fatty acid oxyalkylated amine derivative selected from fatty acid amides, fatty acid esters, and fatty acid ester-amides of said oxyalkylated amine and mixtures thereof.

30 Claims, No Drawings

LUBRICATING OIL COMPOSITION

RELATED APPLICATION

This application is a continuation-in-part of application Ser. No. 175,761 filed Mar. 31, 1988, now abandoned.

BACKGROUND OF THE INVENTION

In order to conserve energy, automobiles are being engineered to give improved gasoline mileage compared to those in recent years. This effort is a result of Federal Regulations which were enacted to compel auto manufacturers to achieve prescribed gasoline mileage. These regulations are to conserve crude oil. In an effort to achieve the required mileage, new cars are being down-sized and made much lighter. However, there are limits in this approach beyond which the cars will not accommodate a typical family.

Another way to improve fuel mileage is to reduce engine wear attributable in part to engine friction. The present invention is concerned with this latter approach.

The smaller engines in use today also require motor oils of higher over-all performance, for example with respect to reducing sludge formation. One problem associated with formulating such high performance oils is the precipitation of ingredients due to a lack of compatibility of the various additives. One aspect of the invention provides high performance engine oils with superior anti-wear and anti-sludge properties while minimizing such precipitation.

SUMMARY OF THE INVENTION

According to the present invention engine sludge is reduced by operating the engine using a motor oil formulated for use in an engine crankcase containing an additive which comprises a mixture, having a common sulfur linkage, of a sulfurized carboxylic acid ester material and a sulfurized fatty acid oxyalkylated amine derivative selected from sulfurized fatty acid amides, sulfurized fatty acid esters, and sulfurized fatty acid ester-amides of said oxyalkylated amine and mixtures thereof.

Also, according to the present invention, engine friction and sludge are reduced by operating the engine using a motor oil formulated for use in an engine crankcase containing a small amount of the combination of (i) an overbased alkaline earth metal sulfonate having a total base number of at least 100, (ii) a zinc dihydrocarbyl dithiophosphate, (iii) a sulfurized carboxylic acid ester material, and (iv) a sulfurized fatty acid oxyalkylated amine derivative selected from sulfurized fatty acid amides, sulfurized fatty acid esters, and sulfurized fatty acid ester-amides of said oxyalkylated amine and mixtures thereof.

Tests have been carried out which demonstrate that the combination of (i), (ii), (iii) and (iv) promotes wear protection beyond that provided by either individual components (i), (ii) and mixtures of (iii) and (iv) alone or a combination of any two of components (i), (ii) and mixtures of (iii) and (iv) together.

DESCRIPTION OF THE PREFERRED EMBODIMENTS

A preferred embodiment of the invention is a lubricating oil composition comprising a major amount of lubricating oil and a sludge-inhibiting amount of mixture, having a common sulfur linkage, of a sulfurized, transesterified triglyceride derived from fatty oils and a sulfurized fatty acid oxyalkylated amine derivative selected from sulfurized fatty acid amides, sulfurized fatty acid esters, and sulfurized fatty acid ester-amides of said oxyalkylated amine and mixtures thereof.

A further preferred embodiment of the invention is a lubricating oil composition comprising a major amount of lubricating oil and a minor wear-inhibiting amount of the combination of (i) an overbased alkaline earth metal sulfonate having a total base number of at least 100, (ii) a zinc dihydrocarbyl dithiophosphate, (iii) a sulfurized carboxylic acid ester material and (iv) a sulfurized fatty acid alkoxylated amine derivative selected from sulfurized fatty acid amides, sulfurized fatty acid esters, and sulfurized fatty acid ester-amides of said oxyalkylated amine and mixtures thereof.

A further embodiment of the invention is a method of inhibiting wear in an internal combustion engine, said method comprising (1) adding to a lubricating oil a wear-inhibiting amount of the combination of (i) an overbased alkaline earth metal sulfonate having a total base number of at least 100, (ii) a zinc dihydrocarbyl dithiophosphate, (iii) a sulfurized carboxylic acid ester material, and (iv) a sulfurized fatty acid alkoxylated amine derivative selected from sulfurized fatty acid amides, sulfurized fatty acid esters, and sulfurized fatty acid ester-amides of said oxyalkylated amine and mixtures thereof, and (2) placing said lubricating oil in the crankcase of an internal combustion engine.

The first essential component of the wear-inhibiting lubricating oil composition of the invention is an overbased alkaline earth metal sulfonate having a total base number of at least 100, more preferably at least about 300. The "total base number" (TBN) also referred to as "base number" is a measure of the alkaline reserve in the product in terms of its stoichiometric equivalent of mg KOH per gram of product.

Overbased alkaline earth metal sulfonates are derived from sulfonic acids, particularly from petroleum sulfonic acids or alkylated benzene sulfonic acids. Useful sulfonic acids from which the overbased alkaline earth metal sulfonates are prepared have an average molecular weight of about 250–1500, more preferably about 400–1100, and most preferably about 440–600. Examples of specific sulfonic acids include mahogany sulfonic acids, petrolatum sulfonic acids, aliphatic sulfonic acids and cycloaliphatic sulfonic acids. In a highly preferred embodiment, the sulfonic acids are alkaryl sulfonic acids such as alkylbenzene or alkylnaphthalene sulfonic acids. Suitable alkyl groups contain from 10 to about 30 carbon atoms or more. Likewise, higher molecular weight alkyls derived from alkylation with polyolefin (e.g. polybutenes) having molecular weights up to about 2000 can be used to give hydrocarbyl sulfonic acids somewhat above the preferred range, but still useful.

Preferred sulfonic acids are the alkaryl sulfonic acids also referred to as alkylbenzene sulfonic acids.

Alkaryl sulfonic acids can be made by conventional methods such as by alkylating benzene, toluene or naphthalene or aromatic mixtures with olefins containing about 10–30 carbon atoms or more (e.g. with polyolefin). The most suitable olefins are cracked-wax olefins, propylene trimers and tetramers and olefin mixtures derived from aluminum alkyl chain growth. Alkylation is effected using a Friedel-Crafts (e.g. $AlCl_3$ or $BF_3$)

catalyst. The alkylaromatic mixture contains predominantly mono- and di-alkyl products. These alkyl aromatics are then sulfonated by known methods such as by reaction with sulfuric acid, oleum, sulfur trioxide and the like.

Thus, preferred sulfonic acids include octadecylbenzene sulfonic acid, didodecylbenzene sulfonic acid, docosylbenzene sulfonic acid, triacontylbenzene sulfonic acid, dodecyloctadecylbenzene sulfonic acid, didecylbenzene sulfonic acid, dodecylnaphthalene sulfonic acid, hexadecylnaphthalene sulfonic acid, dinonylbenzene sulfonic acid and mixtures thereof and the like.

The hydrocarbyl sulfonic acids preferably have an average molecular weight of about 250–1500. More preferred are the alkylbenzene sulfonic acids having an average molecular weight of about 400–1100 and most preferably 440–600.

The overbased alkaline earth metal sulfonates are produced by neutralizing the sulfonic acid with an alkaline earth metal base to form an alkaline earth metal sulfonate salt and then overbasing the alkaline earth metal sulfonate with the corresponding alkaline earth metal carbonate. The process is conducted to give a total base number of at least 100, more preferably at least 300. There is no real maximum on total base number, but for practical purposes they seldom exceed about 550.

Overbased calcium petroleum sulfonates or alkaryl (e.g. alkylbenzene) sulfonates are especially preferred. These are prepared by neutralizing the corresponding petroleum sulfonic acid or alkylated benzene sulfonic acid with a calcium base to form a calcium sulfonate salt and then overbasing the calcium sulfonate with calcium carbonate generally by passing carbon dioxide through a mixture of the neutral calcium sulfonate, mineral oil, lime and water.

Such additives are available commercially. For example, an overbased calcium sulfonate produced from a synthetic benzene sulfonic acid having a TBN of 310 can be obtained from Ethyl Petroleum Additives, Inc. under the designation HiTEC® 611.

The second essential component of the wear-inhibiting lubricating oil composition of the invention is a zinc dihydrocarbyldithiophosphate (ZDDP). Both zinc dialkyldithiophosphates and zinc dialkaryldithiophosphates as well as mixed alkyl-aryl ZDDP are useful. A typical alkyl-type ZDDP contains a mixture of isobutyl and isoamyl groups. Zinc dinonylphenyldithiophosphate is a typical aryl-type ZDDP.

Preferred zinc dithiophosphate components of the lubricating oil composition of the invention are represented by the formula:

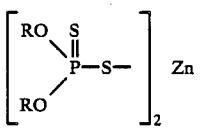

in which R is a hydrocarbyl radical having from 3 to 12 carbon atoms. The most preferred zinc dithiophosphates are those in which R represents an alkyl radical having from 3 to 8 carbon atoms such as isopropyl, isobutyl, isoamyl and 2-ethylhexyl. Examples of suitable compounds include zinc isobutyl 2-ethylhexyl dithiophosphate, zinc di(2-ethylhexyl)dithiophosphate, zinc isopropyl 2-ethylhexyl dithiophosphate, zinc isoamyl 2-ethylhexyl dithiophosphate and zinc dinonylphenyldithiophosphate.

Such additives are also available commercially. For example, a mixed 2-ethylhexyl, 2-methylpropyl, isopropyl ester of phosphorodithioic acid, zinc salt can be obtained from Ethyl Petroleum Additives, Inc. under the designation HiTEC® 685.

The third essential component of the wear-inhibiting lubricating oil composition of the invention is a sulfurized carboxylic acid ester material.

The sulfurized fatty acid ester materials are prepared by reacting sulfur, sulfur monochloride, and/or sulfur dichloride with an unsaturated fatty ester under elevated temperatures. Typical esters which can be used to prepare the sulfurized carboxylic acid ester material include $C_1$–$C_{20}$ alkyl esters of $C_8$–$C_{24}$ unsaturated fatty acids such as palmitoleic, oleic, ricinoleic, petroselinic, vaccenic, linoleic, linolenic, oleostearic, licanic, paranaric, tariric, gadoleic, arachidonic, cetoleic, etc. Other fatty acid ester materials obtained from animal fats and vegetable oils, such as tall oil, linseed oil, olive oil, castor oil, peanut oil, rope oil, fish oil, sperm oil, coconut oil, lard oil, soybean oil and mixtures thereof, can also be used in the present invention.

Exemplary fatty esters include lauryl tallate, methyl oleate, ethyl oleate, lauryl oleate, cetyl oleate, cetyl linoleate, lauryl ricinoleate, oleyl linoleate, oleyl stearate, and alkyl glycerides.

A preferred sulfurized carboxylic acid ester material comprises sulfurized, transesterified, triglycerides derived from fatty acids and fatty oils (e.g. oils selected from coconut, lard, tallow, palm, soybean, and peanut oils and mixtures thereof). Examples of such material are disclosed in U.S. Pat. No. 4,380,499 whose disclosure is incorporated herein by reference. The acid moiety of the triglycerides disclosed in the patent consists of an acid mixture having no more than about 65 mole % unsaturated acids, mainly mono-unsaturated, and no less than about 35 mole % saturated aliphatic acids. Of the total acid moiety, less than about 15 mole % are saturated acids having 18 or more carbon atoms and more than about 20 mole % are saturated acids having 6 to 16 carbon atoms including more than about 10 mole % saturated aliphatic acids having 6 to 14 carbon atoms. Less than about 15 mole % are poly-unsaturated acids and more than about 20 mole % are mono-unsaturated acids. Solubilizing agents such as unsaturated esters and olefins can be incorporated in the material. Such materials are commercially available, for example, from Keil Chemical Divisions of Ferro Corporation under the trademark SUL-PERM® 307.

The fourth essential ingredient of the wear-inhibiting lubricating oil composition of the invention is a component selected from sulfurized fatty acid esters, sulfurized fatty acid amides and sulfurized fatty acid ester-amides of an alkanol amine or mixtures thereof, said amine having the formula:

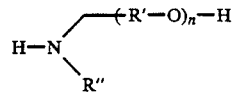

wherein R' is a divalent aliphatic hydrocarbon radical containing 2–4 carbon atoms, n is an integer from 1 to 10 and R'' is selected from hydrogen and the group $-(R'O)_n-H$.

These compounds can be made by reacting a sulfurized fatty acid with an oxyalkylated amine (e.g. diethanolamine) as disclosed, for example, in U.S. Pat. No. 4,201,684.

Another method is to first make the fatty acid ester, amide or ester-amide by reacting a fatty acid with an oxyalkylated amine (e.g. diethanolamine) as disclosed, for example, in U.S. Pat. No. 4,208,293 and then react that intermediate with elemental sulfur at elevated temperature (e.g. 100. to 250° C.) either alone or in combination with the sulfurized fatty acid ester of component (iii). Sulfurized fatty acids can be made by heating a mixture of fatty acid with elemental sulfur.

The components can be separated by distillation and used separately in lubricating oil compositions or they can be used as mixtures. When equal mole mixtures of sulfurized fatty acid and dialkanolamine are reacted, very little ester-amide forms and the product contains mainly amide because of the greater reactivity of the HN<group. However, when over one mole of fatty acid is reacted with a mole of dialkanolamine increased amounts of ester-amide can form.

The preferred amines used to make the compounds which comprise the fourth essential component of the wear-inhibiting lubricating oil composition of the invention are ethoxylated amines such as ethanolamine, diethanolamine, isopropylamine and the like. As stated previously, these can be reacted to form both amides, esters and ester-amides. Using diethanolamine as an example, sulfurized oleic acid, (S)oleic reacts as follows:

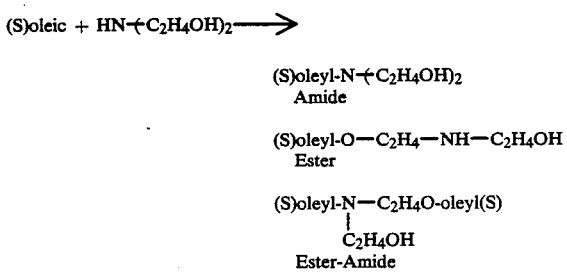

Alternatively, the fatty acids such as oleic acid may be reacted first with an ethoxylated amine and the product formed thereby can then be blended with and cosulfurized in combination with the fatty acid esters such as soybean oil used in the preparation of component (iii) of the lubricating oil compositions of the invention. Preferred fatty acids used in making the amide, ester, ester-amide compounds which make up the fourth component of the lubricating oil compositions of the invention are those containing about 8–20 carbon atoms. Examples of these are hypogeic acid, oleic acid, linoleic acid, elaidic acid, abietic acid, dihydroabietic acid, dehydroabietic acid, tall oil fatty acids, erucic acid, brassidic acid, caprylic acid, pelargonic acid, capric acid, undecylic acid, lauric acid, tridecoic acid, myristic acid, palmitic acid, stearic acid, arachidic acid and mixtures thereof.

Most preferably, the fatty acid component is a mixture of acids derived from coconut oil.

In general, it is preferred that components (iii) and (iv) be used in amounts ranging from about 60% by weight to about 40% by weight of component (iii) to about 40% by weight to about 60% by weight of component (iv). However, amounts of components (iii) or (iv) either above or below this range can be employed in the practice of the invention provided that amounts of components (iii) and (iv) are used which when combined with components (i) and (ii) are sufficient to reduce engine wear in internal combustion engines operated on lubricating oil compositions containing components (i)–(iv).

Components (iii) and (iv) of the invention can be obtained commercially as sulfurized mixtures. For example, a commercial product containing about 6 weight percent sulfur consisting essentially of a high temperature blend having a common sulfur linkage of sulfurized esters of mixed animal and vegetable oils comprising transesterified triglycerides containing a mixture of saturated and mono- and polyunsaturated monobasic acids in which most of the free acid has been esterified with mono-alcohols (approximately 60% by weight) as disclosed in U.S. Pat. No. 4,380,499 (Keil SP307) and the reaction product of diethanolamine and fatty acids derived from selected acids and oils including coconut oil (approximately 40% by weight) (Keil KDP 55-271 whose iodine number is 7.3 centigrams $I_2$ per gram of fatty product which indicates a largely saturated product) is available from the Keil Chemical Division of Ferro Corporation under the trademark "SULPERM® 60-93".

The additives can be used in mineral oil or in synthetic oils of viscosity suitable for use in the crankcase of an internal combustion engine. Crankcase lubricating oils have a viscosity up to about 80 SUS at 210° F. According to the present invention, the additives function to reduce friction losses which take place within the engine and thereby increase fuel economy when added to lubricating oil compositions formulated for use in the crankcase of internal combustion engines. Similar mileage benefits could be obtained in both spark ignited and diesel engines.

Crankcase lubricating oils of the present invention have a viscosity up to about SAE 40. Sometimes such motor oils are given a classification at both 0° and 210° F., such as SAE 10W or SAE 5W30.

Mineral oils include those of suitable viscosity refined from crude oil from all sources including Gulfcoasts, midcontinent, Pennsylvania, California, Alaska and the like. Various standard refinery operations can be used in processing the mineral oil.

Synthetic oil includes both hydrocarbon synthetic oil and synthetic esters. Useful synthetic hydrocarbon oils include polymers of alpha-olefins having the proper viscosity. Especially useful are the hydrogenated liquid oligomers of $C_{6-12}$ alpha-olefins such as alpha-decene trimer. Likewise, alkylbenzenes of proper viscosity can be used, such as didodecylbenzene.

Useful synthetic esters include the esters of both monocarboxylic acid and polycarboxylic acid as well as monohydroxy alkanols and polyols. Typical examples are didodecyl adipate, trimethylol propane tripelargonate, pentaerythritol tetracaproate, di-(2-ethylhexyl)adipate, dilauryl sebacate and the like. Complex esters prepared from mixtures of mono- and dicarboxylic acid and mono- and polyhydroxyl alkanols can also be used.

Blends of mineral oil with synthetic oil are also useful. For example, blends of 5–25 wt.% hydrogenated alpha-decene trimer with 75–95 wt.% 150 SUS (100° F.) mineral oil. Likewise, blends of about 5–25 wt.% di-(2-ethylhexyl)adipate with mineral oil of proper viscosity results in a useful lubricating oil. Also, blends of synthetic hydrocarbon oil with synthetic esters can be used. Blends of mineral oil with synthetic oil are useful when preparing low viscosity oil (e.g. SAE 5W30) since they permit these low viscosities without contributing excessive volatility.

The lubricating oil compositions of the present invention can also contain any of the additives conventionally added to such compositions such as, for example, viscosity index improvers, antioxidants, dispersants, detergents and the like provided, of course, that the presence of such additional additives in the compositions does not interfere with the wear-inhibiting effects of the additives of the present invention.

For example, viscosity index improvers can be included such as the polyalkylmethacrylate type or the ethylene-propylene copolymer type. Likewise, styrene-diene VI improvers or styrene-acrylate copolymers can be used. Alkaline earth metal salts of phosphosulfurized polyisobutylene are useful.

Most preferred crankcase oils also contain an ashless dispersant such as the polyolefin-substituted succinamides and succinimides of polyethylene polyamines such as tetraethylenepentamine. The polyolefin succinic substituent is preferably a polyisobutene group having a molecular weight of from about 800 to 5,000. Such ashless dispersants are more fully described in U.S. Pat. No. 3,172,892 and U.S. Pat. No. 3,219,666 incorporated herein by reference.

Another useful class of ashless dispersants are the polyolefin succinic esters of mono-and polyhydroxyl alcohols containing 1 to about 40 carbon atoms. Such dispersants are described in U.S. Pat. No. 3,381,022 and U.S. Pat. No. 3,522,179.

Likewise, mixed ester/amides of polyolefin substituted succinic acid made using alkanols, amines and/or aminoalkanols represent a useful class of ashless dispersants.

The succinic amide, imide and/or ester type ashless dispersants may be boronated by reaction with a boron compound such as boric acid. Likewise, the succinic amide, imide and/or ester may be oxyalkylated by reaction with an alkylene oxide such as ethylene oxide or propylene oxide.

Other useful ashless dispersants include the Mannich condensation products of polyolefin-substituted phenols, formaldehyde and polyethylene polyamine. Preferably, the poly olefin phenol is a polyisobutylene-substituted phenol in which the polyisobutylene group has a molecular weight of from about 800 to 5,000. The preferred polyethylene polyamine is tetraethylene pentamine. Such Mannich ashless dispersants are more fully described in U.S. Pat. No. 3,368,972; U.S. Pat. No. 3,413,347; U.S. Pat. No. 3,442,808; U.S. Pat. No. 3,448,047; U.S. Pat. No. 3,539,633; U.S. Pat. No. 3,591,598; U.S. Pat. No. 3,600,372; U.S. Pat. No. 3,634,515; U.S. Pat. No. 3,697,574; U.S. Pat. No. 3,703,536; U.S. Pat. No. 3,704,308; U.S. Pat. No. 3,725,480; U.S. Pat. No. 3,726,882; U.S. Pat. No. 3,736,357; U.S. Pat. No. 3,751,365; U.S. Pat. No. 3,756,953; U.S. Pat. No. 3,793,202; U.S. Pat. No. 3,798,165; U.S. Pat. No. 3,798,247; and U.S. Pat. No. 3,803,039.

The above Mannich dispersants can be reacted with boric acid to form boronated dispersants having improved corrosion properties.

Conventional blending equipment and techniques may be used in preparing the lubricating oil compositions of the present invention. In general, a homogeneous blend of the foregoing active components is achieved by merely blending all four components of the present invention separately, together or in any combination or sequence with the lubricating oil in a determined proportion sufficient to reduce the wear tendencies of the lubricating oil composition. This is normally carried out at ambient temperature. The selection of the particular base oil and components, as well as the amounts and ratios of each depends upon the contemplated application of the lubricant and the presence of other additives. In general, however, the amount of overbased alkaline earth metal sulfonate in the lubricating oil will vary from about 0.5 to 5.0, and usually from about 0.75 to 1.5 weight percent based on the weight of the final composition. The amount of zinc dihydrocarbyl dithiophosphate in the lubricating oil will vary from about 0.5 to 3.0, and usually from about 1.0 to 2.0 weight percent based on the weight of the final composition. The amount of sulfurized carboxylic acid ester in the lubricating oil will vary from about 0.025 to 3.0, and usually from about 0.2 to 0.4 weight percent based on the weight of the final composition. The amount of sulfurized fatty acid amide, ester or ester-amide of oxyalkylated amine or mixtures thereof will vary from about 0.025 to 3.0, and usually from about 0.15 to 0.35 weight percent based on the weight of the final composition.

In many cases, a preferred way to add the present additives to lubricating oil is in the form of an additive package. These are concentrates dissolved in a diluent such as mineral oil, synthetic hydrocarbon oils and mixtures thereof which, when added to a base oil, will provide an effective concentration of the present additives and other known conventional additives such as those listed above. The various additives are present in a proper ratio such that when a quantity of the concentrate is added to lubricating oil the various additives are all present in the proper concentration. For example, if the desired use level of a particular additive component is 0.2 wt.% and the final formulated oil is made by adding 10 parts of the additive package to 90 parts of base lubricating oil, then the additive pack will contain 2.0 wt.% of that particular additive component. Usually the concentrate will be 95.0 to 99.9 percent by weight additive composition and from 5.0 to 0.1 percent by weight lubricating oil diluent. Preferably, the additive composition comprises 97 to 99 percent by weight of the lubricating oil additive concentrate. This concentrate is diluted with additional lubricating oil before use such that the finished lubricating oil product contains from about 5.0 to 25.0 percent by weight of concentrate.

The following formulation illustrates the preparation of a typical additive concentrate of this invention. Parts are by weight.

Zinc dialkyldithiophosphate: 0.5–3.0 parts
Overbased calcium alkylbenzene sulfonate (TBN 310): 0.5–5.0 parts
SUL-PERM ® 60-93: 0.1–3.0 parts.

The lubricity or wear properties of the lubricating oil compositions of the present invention were determined in the 4-Ball Wear Test. This test is conducted in a device comprising four steel balls, three of which are in contact with each other in one plane in a fixed triangular position in a reservoir containing the test sample. The fourth ball is above and in contact with the other three. In conducting the test, the upper ball is rotated while it is pressed against the other three balls while pressure is applied by weight and lever arms. The diameter of the scar on the three lower balls is measured by means of a low power microscope, and the average diameter measured in two directions on each of the three lower balls is taken as a measure of the anti-wear characteristics of the oil. A larger scar diameter means more wear. The balls were immersed in base lube oil containing the test additives. Applied load was 40 kg and rotation was at 1,800 rpm for 30 minutes at 130° F. Tests were conducted both with base oil alone (Exxon 100 neutral low pour base stock mineral oil) and with lube oil blends having the following compositions:

Blend A=Base oil containing 1.2 wt.% zinc dialkyldithiophosphate (HiTEC® 685).

Blend B=Base oil containing 1.3 wt.% overbased calcium alkylbenzene sulfonate, TBN 310 (HiTEC® 611).

Blend C=Base oil containing 0.5% wt.% SUL-PERM® 60-93.

Blend D=Base oil containing 1.2 wt.% zinc dialkyldithiophosphate (HiTEC® 685)+0.5 wt.% SUL-PERM® 60-93.

Blend E=Base oil containing 1.2 wt.% zinc dialkyldithiophosphate (HiTEC® 685)+1.3 wt.% overbased calcium alkylbenzene sulfonate, TBN 310 (HiTEC® 611).

Blend F=Base oil containing 1.3 wt.% overbased calcium alkylbenzene sulfonate, TBN 310 (HiTEC® 611)+0.5 wt.% SUL-PERM® 60-93.

Blend G=Base oil containing 1.2 wt.% zinc dialkyldithiophosphate (HiTEC® 685)+1.3 wt.% overbased calcium alkylbenzene sulfonate, TBN 310 (HiTEC® 611) +0.5 wt.% SUL-PERM® 60-93.

Results are given in the following table.

| Oil Formulation | Scar Diameter (mm) |
|---|---|
| Base Oil | 1.47* |
| Blend A | 0.633 |
| Blend B | 0.688 |
| Blend C | 0.527 |
| Blend D | 0.483 |
| Blend E | 0.544 |
| Blend F | 1.658 |
| Blend G | 0.352 |

*The run was terminated after 5 seconds due to excessive vibrations and noise at which time the scar diameter was 1.47 mm.

The results in the table show that Blend G containing all four components of the present invention gave a scar diameter significantly less than the other blends.

In addition to providing engine wear reduction properties to lubricating oil compositions formulated for use in engine crankcases, the additive combinations of the present invention are also deemed to impart detergency properties to lubricating oils containing same so as to inhibit sludge formation.

Accordingly, the presence of the high temperature blend, having a common sulfur linkage, of additives (iii) and (iv) has been found to provide a compatible lubricant oil additive package which significantly reduces engine sludge formation as determined by laboratory bench and engine testing. Generally, suitable amounts of the blend to inhibit sludge range from about 0.05 to about 6 percent by weight based on the total weight of lubricating oil composition (preferred about 0.3 to 3.5 weight percent). Additive concentrates generally contain from about 2 to 25 percent by weight of such high temperature blend of components (iii) and (iv).

Four oil blends were tested in the VE engine test with and without the presence of 0.5 weight % of the SUL-PERM® 60-93 additive. Blends A', B', and C' are fully formulated 5W30 oils made by combining a base oil with zinc dialkyldithiophosphate ester (ZDDP) antiwear, neutral and overbased calcium sulfonate detergents, alkenylsuccinimide ashless dispersant, antioxidants, antifoam agent pour point depressant, viscosity index (VI) improver and, in Blend C' a rust inhibitor. Blend D' is a fully formulated SAE 30 oil which is made from a base oil containing the above additives except for the VI improver and rust inhibitor. The results are reported in the following table.

| Blend | VE Sludge Rating[1] Without Additive | VE Sludge Rating With Additive | Effect |
|---|---|---|---|
| A' | 7.79 | 9.15 | +1.36 |
| B' | 7.32 | 9.02 | +1.70 |
| C' | 6.67 | 8.79 | +2.12 |
| D' | 5.98 | 8.98 | +3.00 |

[1]Rating Scale: 10 is a perfectly clear (sludge free) engine. 9 is a "pass".

The results in the table show that the presence of the additive significantly improved the sludge rating of all four oil blends. The function of the two ingredients of the sulfurized blend is not exactly understood except that fatty acid diethanol amides (Nippon Cooper FRM-213 or Keil KDP55-271 additives), provided improved four-ball, and laboratory VE sludge bench test results but the additive packages became hazy after standing for 1 day at both room temperature (RT) and at 70° C. which indicated a lack of additive ingredient compatibility which could lead to performance problems due to the precipitation from the concentrate or finished oil of additive material. In contrast, the cosulfurized mixtures of sulfurized fatty acid and diethanolamide (Keil SP60-93 or cosulfurized Keil KDP55-271 and Keil SP307 additives) provided packages which remained clear after, respectively, 6 and 3 days. The co-sulfurized mixture of Schercomid SCO-extra and soybean oil showed only a trace of haze after 28 days at room temperature and was clear at 70° C. after 28 days. The data are recorded in the following table in which the parenthetical amounts represent the weight percent additive.

| Additive | 4 Ball Wear (3-Comp)[3] | 4 Ball Wear (Full Pack)[4] | VE Sludge Bench Test[4,5] | Compatibility[6] RT | Compatibility[6] 70° C. |
|---|---|---|---|---|---|
| Coconut Oil Fatty acid diethanolamide (Keil KDP55-271) | 0.344mm (.2%) | 0.369 (.2%) | 67.3 (.2%) | Med Haze (1 day) | Med Haze (1 day) |
| Oleyl Fatty acid diethanolamide (FRM-213 Nippon Cooper) | 0.363mm (.3%) | 0.369 (.5%) | 68.2 (.2%) | Med Haze (1 day) | Med Haze (1 day) |
| Cosulfurized fatty acid ester (Keil SP307) and fatty acid diethanolamide (KDP55-271)[1] | 0.358mm (.5%) | 0.340 (.5%) | 76.5 (.5%) | Clear (3 days) | Clear (3 days) |
| Cosulfurized fatty acid ester and fatty acid diethanolamine (Keil SP60-93) | 0.365mm (.5%) | 0.369 (.5%) | 67.1 (.5%) | Clear (6 days) | Clear (6 days) |

-continued

| Additive | 4 Ball Wear (3-Comp)[3] | 4 Ball Wear (Full Pack)[4] | VE Sludge Bench Test[4,5] | Compatibility[6] RT | Compatibility[6] 70° C. |
|---|---|---|---|---|---|
| Cosulfurized coconut oil fatty acid diethanol-amide (Schercomid SCO-extra) and soybean oil[2] | 0.367mm (.5%) | 0.342 (.5%) | 46.7 (.5%) | Trace Haze (28 days) | Clear (28 days |
| Control | 0.544mm (0%) | 0.413 (0%) | 98.5 (0%) | — | — |

[1]Prepared by heating a mixture of 120 grams sulfurized fatty acid ester, 80.0 grams amide, and 4.68 grams of elemental sulfur with 1 gram of 2,5-dimercapto-1,3,4-thiadiazole as catalyst (DMTD) at 160° C. for 2 hours.

[2]Prepared by heating a mixture of 60 grams cocodiethanolamide, 90 grams soybean oil, 9.57 grams sulfur and 0.80 grams of 2,5-dimercapto-1,3,4-thiadiazole (DMTD) to 160° C. with stirring for 30 minutes while allowing water vapor to escape and then cooling to avoid side reactions. The product contained 6% by weight sulfur.

[3]Similar to Blend G above except with substitution of the listed additive.

[4]Fully formulated SAE 5W30 oil made by adding to base oil, succinimide dispersant, ZDDP antiwear, neutral and overbased calcium sulfonate detergents, antioxidants, antifoam agent, pour point depressant and VI improver.

[5]After 22-30 hours HOOT (Hot Oil Oxidation Test) the change in dielectric constant is determined. The oxidized oil is mixed with a known amount of standard oxidized oil (a laboratory preparation) and diluted with a hydrotreated basestock. Turbidity measurements are then taken. The dielectric constant measurement, HOOT time and turbidity data are combined into a single number for reporting and comparison purposes. A lower number indicates better anti-sludge properties.

[6]Compatibility of the listed additive with a conventional additive package used by oil blenders to prepare finished lubricating oils. The package used contains the same additives as the full pack of note 4 except that no VI improver or pour point depressant is present.

[7]This test was run on a different date from the others. The control gave a value of 77.6 and the run with Keil SP60-93 gave a value of 51.7 indicating a milder test.

What is claimed:

1. A composition comprising an oil of lubricating viscosity and from about 0.05 to about 25 percent by weight, based on the total weight of composition, of a cosulfurized blend of a carboxylic acid ester and a fatty acid oxyalkylated amine derivative selected from fatty acid amides, fatty acid esters, and fatty acid ester-amides of said oxyalkylated amine and mixtures thereof.

2. A lubricant oil additive concentrate comprising a diluent oil of lubricating viscosity and from about 2 to 25 weight percent, based on the total weight of concentrate, of a cosulfurized blend of a carboxylic acid ester and a fatty acid oxyalkylated amine derivative selected from fatty acid amides, fatty acid esters, and fatty acid ester-amides of said oxyalkylated amine and mixtures thereof.

3. The composition of claim 2 wherein the oxyalkylated amine is diethanolamine and the ester comprises a transesterified triglyceride in which the total acid component of said triglyceride comprises no less than about 35 mole % saturated aliphatic acids.

4. The concentrate of claim 3 wherein said blend is prepared by reacting a mixture of a sulfurized, transesterified triglyceride and a fatty acid amide of diethanolamine with elemental sulfur at elevated temperature of about 100° to 250° C.

5. The composition of claim 3 wherein said triglyceride is present in an amount of from about 40 to 60 percent by weight of said blend.

6. The composition of claim 1 wherein the composition is a lubricating oil formulated for use in the crankcase of an internal combustion engine which contains from about 0.05 to about 6.0 percent by weight of said blend based on the total weight of composition.

7. The composition of claim 1 wherein said carboxylic acid ester comprises soybean oil and said oxyalkylated amine is diethanol amine.

8. The concentrate of claim 2 wherein said carboxylic acid ester comprises soybean oil and said oxyalkylated amine is diethanol amine.

9. The composition of claim 8 wherein said blend is prepared by reacting a mixture of soybean oil and a fatty acid amide of diethanolamine with elemental sulfur at elevated temperature of about 100° C. to 250° C.

10. A method of reducing sludge in an internal combustion engine said method comprising (a) adding to a lubricating oil a sludge inhibiting amount of a cosulfurized blend of a carboxylic acid ester and a fatty acid amide of diethanolamine, and (b) placing said lubricating oil in the crankcase of an internal combustion engine.

11. The method of claim 10 wherein said sludge inhibiting amount of said blend is from about 0.05 to about 6.0 percent by weight based on the weight of said oil.

12. The method of claim 10 wherein said sludge inhibiting amount of said blend is from about 0.3 to 3.5 percent by weight based on the weight of said oil.

13. The concentrate of claim 2 wherein said oxyalkylated amine is an alkanol amine having the formula:

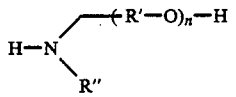

wherein R′ is a divalent aliphatic hydrocarbon radical containing 2–4 carbon atoms, n is an integer from 1 to 10 and R″ is selected from hydrogen and the group $-(R'O)_n-H$.

14. The concentrate of claim 2 which also includes an ashless dispersant.

15. The concentrate of claim 2 wherein said amine derivative is a fatty acid amide of said oxyalkylated amine.

16. The concentrate of claim 15 wherein said oxyalkylated amine is diethanol amine.

17. The concentrate of claim 2 wherein said carboxylic acid ester comprises a $C_1$–$C_{20}$ alkyl ester of a $C_8$–$C_{24}$ unsaturated fatty acid.

18. The concentrate of claim 2 wherein said cosulfurized bland includes from about 40 to 60 wt % of said ester and from about 60 to 40 % of said amine derivative.

19. The composition of claim 1 wherein said oxyalkylated amine is an alkanol amine having the formula:

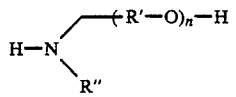

wherein R′ is a divalent aliphatic hydrocarbon radical containing 2–4 carbon atoms, n is an integer from 1 to 10 and R″ is selected from hydrogen and the group $-(R'O)_n-H$.

20. The composition of claim 1 wherein the oxyalkylated amine is diethanol amine and the ester comprises a transesterified triglyceride in which the total acid component of said triglyceride comprises no less than about 35 mole % saturated aliphatic acids.

21. The composition of claim 1 which also contains an ashless dispersant.

22. The composition of claim 1 wherein said amine derivative is a fatty acid amide of said oxyalkylated amine.

23. The composition of claim 21 wherein said oxyalkylated amine is diethanol amine.

24. The composition of claim 1 wherein said carboxylic acid ester comprises a $C_1$–$C_{20}$ alkyl ester of a $C_8$–$C_{24}$ unsaturated fatty acid.

25. The composition of claim 1 wherein said cosulfurized blend includes from about 40 to 60 wt % of said ester material and from about 60 to 40 wt % of said amine derivative.

26. The method of claim 11 wherein an ashless dispersant is also added to the oil.

27. A lubricant oil additive concentrate comprising a diluent oil of lubricating viscosity and from about 2 to 25 weight percent, based on the total weight of concentrate, of a cosulfurized blend containing 40 to 60 wt % of a $C_1$–$C_{20}$ alkyl ester of a $C_8$–$C_{24}$ unsaturated fatty acid and 60 to 40 wt % of a $C_8$–$C_{20}$ fatty acid oxyalkylated amine derivative selected from fatty acid amides, fatty acid esters, and fatty acid ester-amides of said oxyalkylated amine and mixtures thereof wherein the oxyalkylated amine is an alkanol amine having the formula:

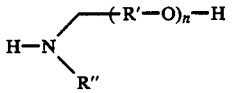

wherein R′ is a divalent aliphatic hydrocarbon radical containing 2–4 carbon atoms, n is an integer from 1 to 10 and R″ is selected from hydrogen and the group $-(R'O)_n-H$.

28. The concentrate of claim 27 wherein said carboxylic acid ester is selected from a transesterified triglyceride, in which the total acid component of said triglyceride comprises no less than about 35 mole % selected aliphatic acid, and soybean oil, said oxyalkylated amine is diethanol amine, the fatty acid portion of the amine derivative is selected from coconut oil fatty acids and oleic acid and the amine derivative is a fatty acid amide.

29. A composition comprising an oil of lubricating viscosity and from about 0.05 to 6.0 percent by weight, based on the total weight of composition, of a cosulfurized blend containing 40 to 60 wt % of a $C_1$–$C_{20}$ alkyl ester of a $C_8$–$C_{24}$ unsaturated fatty acid and 60 to 40 wt % of a $C_8$–$C_{20}$ fatty acid oxyalkylated amine derivative selected from fatty acid amides, fatty acid esters, and fatty acid ester-amides of said oxyalkylated amine and mixtures thereof wherein the oxyalkylated amine is an alkanol amine having the formula:

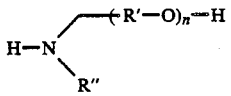

wherein R′ is a divalent aliphatic hydrocarbon radical containing 2–4 carbon atoms, n is an integer from 1 to 10 and R″ is selected from hydrogen and the group $-(R'O)_n-H$.

30. The composition of claim 29 wherein said carboxylic acid ester is selected from a transesterified triglyceride, in which the total acid component of said triglyceride comprises no less than about 35 mole % saturated aliphatic acid, and soybean oil, said oxyalkylated amine is diethanol amine, the fatty acid portion of the amine derivative is selected from coconut oil fatty acids and oleic acid and the amine derivative is a fatty acid amide.

* * * * *

UNITED STATES PATENT AND TRADEMARK OFFICE

CERTIFICATE OF CORRECTION

PATENT NO. : 4,960,530

DATED : OCTOBER 2, 1990

INVENTOR(S) : ARMGARD K. EVERETT, ET AL.

It is certified that error appears in the above-identified patent and that said Letters Patent is hereby corrected as shown below:

Column 11, line 50, reads "composition" and should read -- concentrate --.

Column 11, line 60, reads "composition" and should read -- concentrate --.

Column 12, line 7, reads "composition" and should read -- concentrate --.

Column 12, line 48, reads "bland" and should read -- blend --.

Signed and Sealed this

Twenty-fourth Day of November, 1992

*Attest:*

DOUGLAS B. COMER

*Attesting Officer*

*Acting Commissioner of Patents and Trademarks*